US005797699A

United States Patent [19]

Blancke et al.

[11] Patent Number: 5,797,699

[45] Date of Patent: Aug. 25, 1998

[54] PROCESS AND APPARATUS FOR DYNAMIC SOIL PACKING

[75] Inventors: Uwe Blancke, Koblenz; Karl-Hermann Mötz, Nörtershausen, both of Germany

[73] Assignee: Bomag GmbH, Boppard, Germany

[21] Appl. No.: 841,026

[22] Filed: Apr. 29, 1997

Related U.S. Application Data

[63] Continuation of Ser. No. 531,028, Sep. 20, 1995, abandoned.

[30] Foreign Application Priority Data

Sep. 29, 1994 [DE] Germany ..... 44 34 779.0

[51] Int. Cl.[6] ..... E01C 19/28

[52] U.S. Cl. ..... 404/117; 404/122

[58] Field of Search ..... 404/114, 117, 404/122, 133.05

[56] References Cited

U.S. PATENT DOCUMENTS 4,546,425 10/1985 Breitholtz ..... 364/153

FOREIGN PATENT DOCUMENTS

A2 0 088 071 9/1983 European Pat. Off. .

A1 0 530 546 3/1993 European Pat. Off. .

A1 3308476 10/1983 Germany .

A1 3421824 12/1985 Germany .

WO 89/07988 9/1989 WIPO .

*Primary Examiner*—James Lisehora

*Attorney, Agent, or Firm*—Panitch Shwarze Jacobs & Nadel, P.C.

[57] ABSTRACT

Dynamic soil packing can be achieved by a procedure and device whereby the vibratory motion of the roller or one of the parts attached to it is determined, and whereby the vertical component of the vibratory force is diminished in the event of a disturbance (e.g., bouncing) of the basic roller vibration. The packing device is one having at least two exciter shafts synchronously rotating in opposite directions and arranged parallel to or in alignment with the roller axis for generating a vibrating motion, the exciter shafts being adjustable in their position and/or phase relationship so that the resulting centrifugal force electively exerts horizontal shearing forces and/or vertical compressive forces in the soil. A motion sensor determines the vibratory motion, such as amplitude, acceleration or periodicity thereof, and in connection with a control loop and adjustable pivot bearing adjusts the horizontal and vertical components of the motion to eliminate the disturbance.

10 Claims, 6 Drawing Sheets

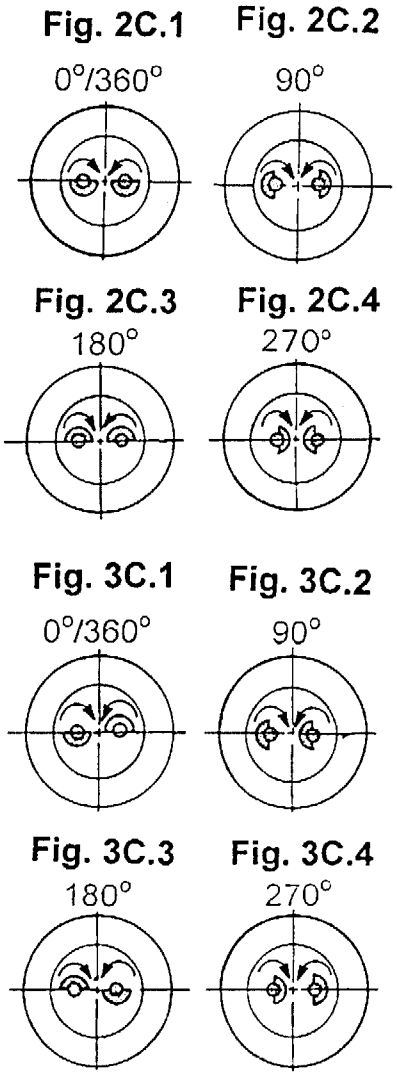
Fig. 2C.1
0°/360°
Fig. 2C.2
90°
Fig. 2C.3
180°
Fig. 2C.4
270°
Fig. 3C.1
0°/360°
Fig. 3C.2
90°
Fig. 3C.3
180°
Fig. 3C.4
270°
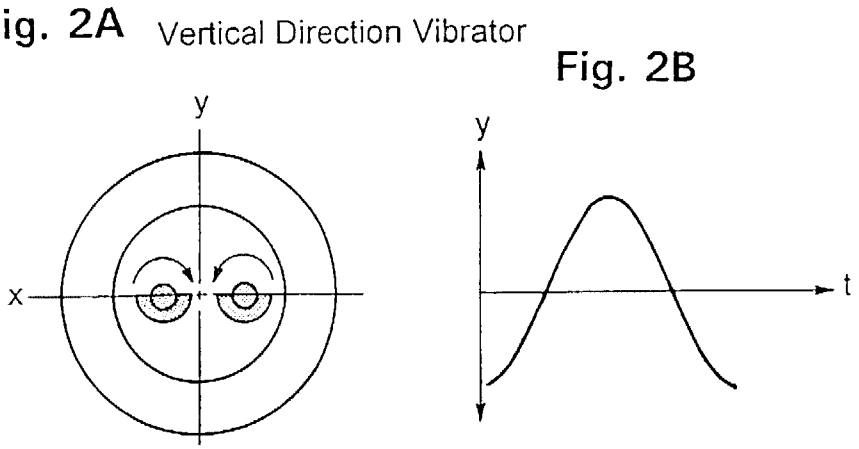
Fig. 2A Vertical Direction Vibrator
Fig. 2B
x
y
t
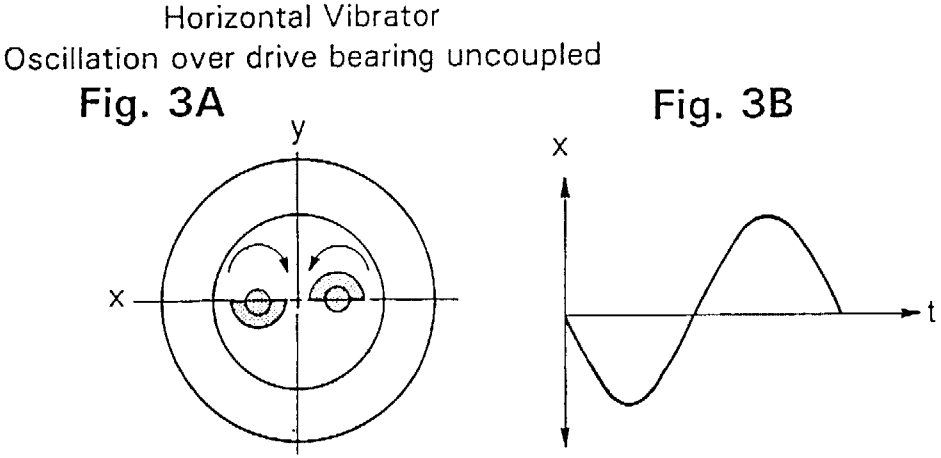
Horizontal Vibrator
Oscillation over drive bearing uncoupled
Fig. 3A
Fig. 3B
x
y
t

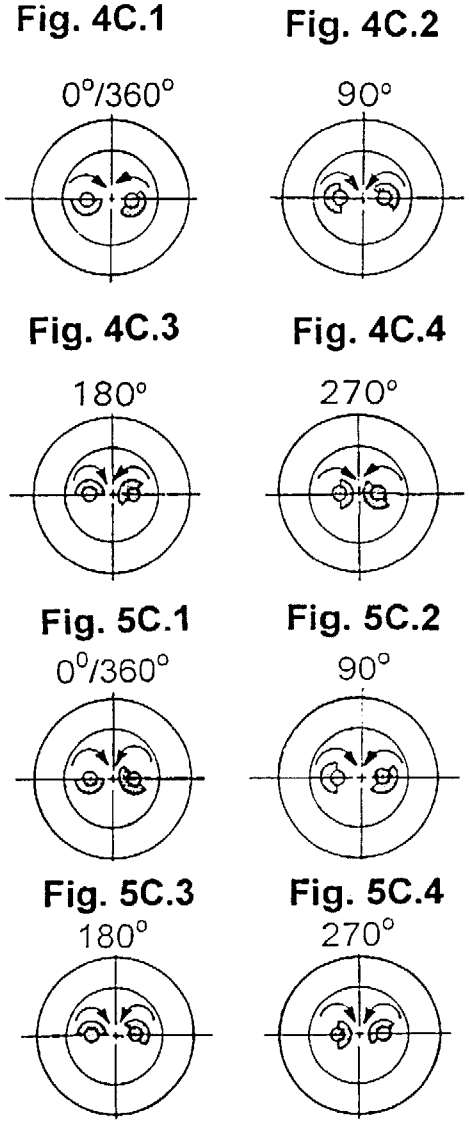
Fig. 4C.1
0°/360°
Fig. 4C.2
90°
Fig. 4C.3
180°
Fig. 4C.4
270°
Fig. 5C.1
0°/360°
Fig. 5C.2
90°
Fig. 5C.3
180°
Fig. 5C.4
270°
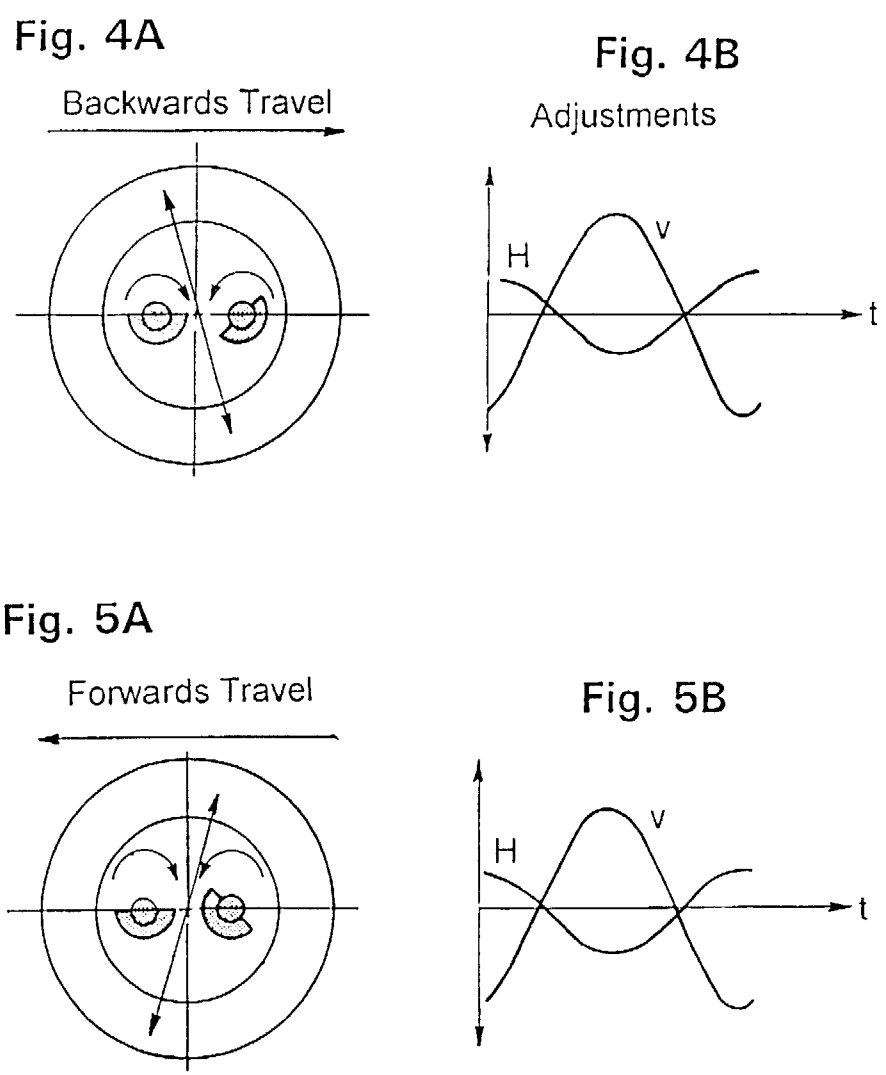
Fig. 4A
Backwards Travel
Fig. 4B
Adjustments
H
V
t
Fig. 5A
Forwards Travel
Fig. 5B
H
V
t Time Diagram
$b_y(m/s^2)$
50
-50
0°
180°
540°
720°

Polar Coordinates
by$(m/s^2)$
50
-50
$b_x$ $(m/s^2)$
50
-50

$b_y(m/s^2)$
50
-50
0°
180°
540°
720°

$b_y(m/s^2)$
50
-50
$b_x$ $(m/s^2)$
50
-50

PROCESS AND APPARATUS FOR DYNAMIC SOIL PACKING

This is a continuation of application Ser. No. 08/531,028, filed Sep. 20, 1995, now abandoned.

FIELD OF THE INVENTION

The invention concerns a process and an apparatus for dynamic soil packing with at least one movable roller which executes vibratory movements, in which a vibration force, adjustable as to direction, acts upon the roller so that electively horizontal shearing forces and/or vertical compressive forces are exerted upon the soil.

BACKGROUND OF THE INVENTION

Such a packing system is known from EP-A 530 546, assigned to the same assignee as the present invention. It has the advantage that packing can take place electively primarily is either with shearing forces or with vertical compressive forces, depending upon soil condition, the depth of the stratum to be packed and other parameters.

The object of further improving this packing system and especially of avoiding over-packing of the soil with local grain crushing and deformation of the track surface underlies the present invention.

SUMMARY OF THE INVENTION

This object is achieved with regard to the procedural features in that the vibrational movement of the roller or one of the parts connected to it is determined, and that in the event of a disturbance of the basic roller vibration, the vertical component of the vibratory force is diminished until the disturbance has been nearly eliminated.

The invention proceeds from the recognition that with increased packing of the soil and correspondingly increasing soil hardness, the packing roller tends to bounce, whereby not only is the packing roller subjected to high mechanical stress, but packing quality also decreases. The driver can generally perceive this bouncing, but only inadequately with his body or visually, and interrupt the packing process, but this is usually too late. In contrast to this, the present invention permits timely reduction of the component of the vibratory movement responsible for the bouncing and the over-compression and conversion of the packing instead increasingly to horizontal shearing forces by which bouncing is precluded. The invention can thus be regarded as an anti-bouncing regulator, on the one hand, and as a barrier to overpacking, on the other. It hence permits also working with higher vibration amplitudes than previously, because damage to the roller owing to hard soils is no longer possible.

Various possibilities for determining disturbances of the basic roller vibration due to bouncing offer themselves to the person skilled in the art. The amplitude of the vibratory movement or a derivative thereof, especially acceleration, can be determined. Thus, for example, the vertical component of acceleration increases with diminishing soil contact by the roller.

Alternatively, the period of the vibratory movement can equally be determined, as in this case almost a doubling occurs in the course of bouncing.

Finally, it is also possible to determine disturbances in the basic roller vibration by conducting a frequency analysis of the sound propagated through the air.

For implementing the packing procedure in accordance with the invention, there is provided a packing device with at least two exciter shafts, synchronously rotating in opposite directions parallel to the rolling axis or aligned with it, the position and/or phase relationship of which can be adjusted in such a manner that their resulting centrifugal force selectively exerts horizontal shearing forces and/or vertical compressive forces on the soil. The procedure in accordance with the invention is then realized in such a manner that the roller or a part connected to it stands in a working connection with a motion sensor for determining the vibratory movement, and that the motion sensor is connected to a control loop which adjusts the position and/or phase relationship of the exciter shafts in the sense of a diminution of the vertical compressive forces, in the event of a disturbance in the basic rolling vibration.

It is recommended for reasons of construction that the exciter shafts be arranged approximately horizontally alongside each other and that shifting between horizontal and vertical centrifugal forces be effected by changing the phase relationship of the exciter shafts, as is known per se. The exciter shafts usually stand in working connection with each other through gears, so that an adjustable pivot bearing can be installed between one exciter shaft and the gear allocated to it for shifting the phase relationship. This pivot bearing appropriately comprises a shifting coil connected with the gear in which an adjusting axle can be screwed in axially, and which can be axially displaced, but which is rotationally fixed with the exciter shaft. The phase relationship should thereby be adjustable by over 150°, in particular up to nearly 360°.

Another possibility comprises mounting the exciter shafts in a frame which can be swivelled about an axis parallel to them and fixed in the desired swivel position. In this way, vertical compressive forces and/or horizontal shearing forces can likewise be electively generated in accordance with EP-A 530 546. Starting with a reference position of the frame with exciter shafts arranged vertically above each other, the frame should be bilaterally adjustable, in particular up to approximately 90°.

It is especially appropriate in both cases to undertake the adjustment of the phase relationship or the adjustment of the position of the exciter shafts as a function of the direction of travel. A component of the vibratory force generated in the roller thereby supports the driving mechanism of the roller instead of working against it.

BRIEF DESCRIPTION OF THE DRAWINGS

The foregoing summary, as well as the following detailed description of a preferred embodiment of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities shown. It can also include combinations of individual features shown, described and/or claimed. In the drawings:

FIG. 2A is a schematic representation of two exciter shafts for generating vertical compressive forces;

FIG. 2B is a phase relationship diagram for the resulting vibratory force from the two exciter shafts shown in FIG. 2A;

FIGS. 2C.1–2C.4 are a series of schematic drawings showing the exciter shafts rotated in 90 degree increments;

FIG. 3A is a representation corresponding to FIG. 2 with changed phase relationship for generating horizontal shearing forces;

FIG. 3B is a phase relationship diagram for the resulting vibratory force from the two exciter shafts shown in FIG. 3A;

FIGS. 3C.1–3C.4 are a series of schematic drawings showing the exciter shafts rotated in 90 degree increments;

FIG. 4A is a similar schematic representation for combined packing in forward travel;

FIG. 4B is a phase relationship diagram for the resulting vibratory force from the two exciter shafts shown in FIG. 4A;

FIGS. 4C.1–4C.4 are a series of schematic drawings showing the exciter shafts rotated in 90 degree increments;

FIG. 5A is a corresponding representation in the case of backward travel;

FIG. 5B is a phase relationship diagram for the resulting vibratory force from the two exciter shafts shown in FIG. 5A;

FIGS. 5C.1–5C.4 are a series of schematic drawings showing the exciter shafts rotated in 90 degree increments;

DETAILED DESCRIPTION OF PREFERRED EMBODIMENT

Figure 1:
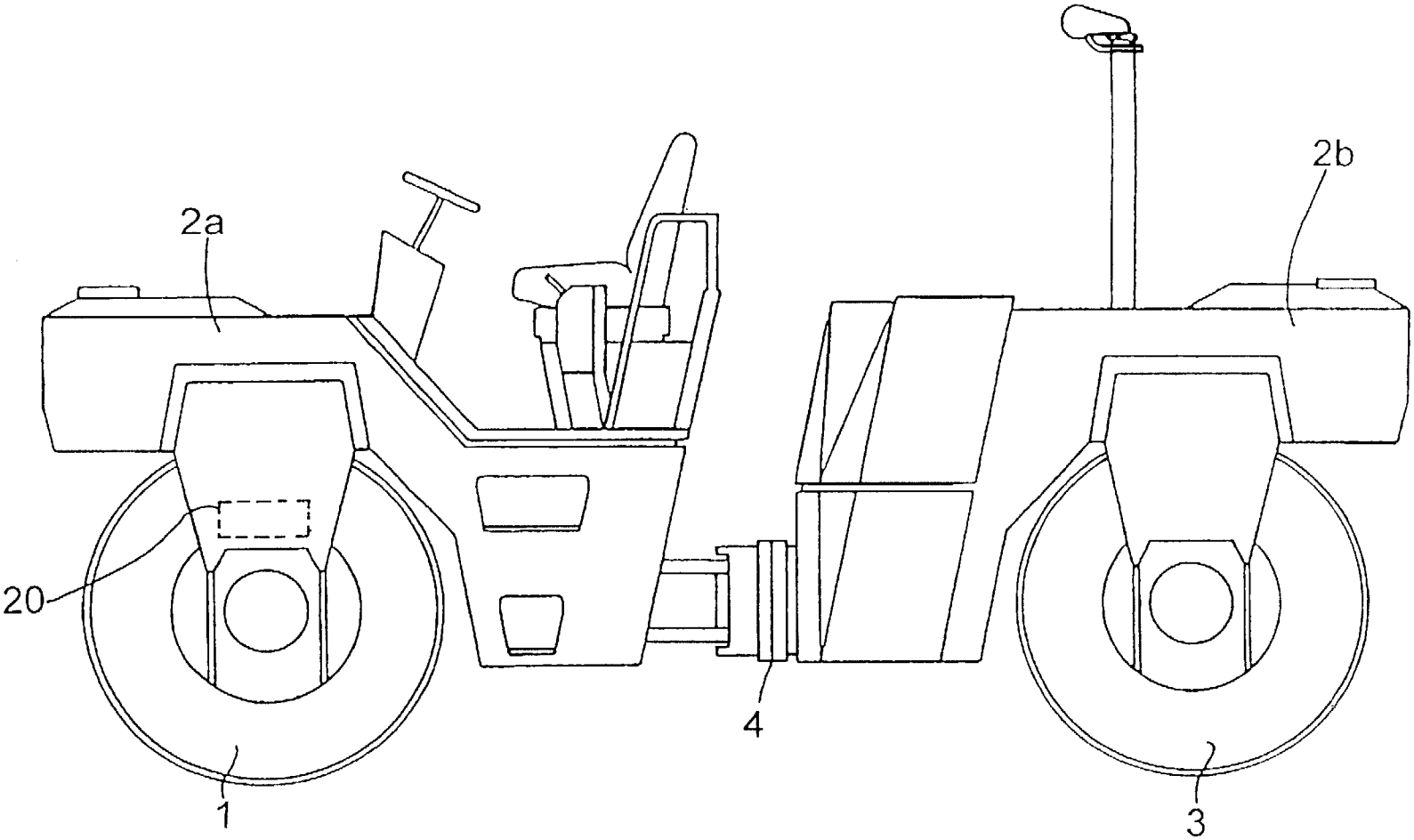
FIG. 1 is a side view of a packing device in its totality.

One recognizes in FIG. 1 a packing device with two vibrator rollers, which externally shows the conventional construction, thus comprising a front roller 1 with body 2*a* and operator's platform and a rear roller 3 with body 2*b*, whereby the two bodies 2*a* and 2*b* are connected with each other through a vertical swivel bearing for the sake of the maneuverability of the vehicle.

FIGS. 2A, 2B and 2C.1–2C.4 schematically depicts the two exciter shafts 5 and 6, which are in any given case disposed in the interior of rollers 1 and 3. In the case of the alternatives here described, the two exciter shafts lie horizontally alongside each other, and they maintain this position independently of roller rotation and independently of whether vertical compressive forces, horizontal shearing forces or a combination of the two are to be generated from this. They rotate in opposite directions, but they can, however, be relatively rotated toward each other with respect to the phase relationship of their imbalances.

The exciter shafts generate a resulting vibratory force with the phase relationship represented in FIGS. 2A and 2B, which acts exclusively in a vertical direction, and to be sure periodically upward and downward. This can easily be recognized in the reduced sized schematic drawings in FIGS. 2C.1–2C.4 where the exciter shafts are rotated an additional 90° in each given case. One sees immediately that the horizontal components of the centrifugal forces generated by the exciter shafts cancel each other in any given case, while the vertical components add to each other. As a result, a sinusoidal vibratory force is generated corresponding to the progression curve depicted in the FIG. 2B.

If, on the other hand, the phase relationship of the two exciter shafts is altered 180° relatively to each other, one obtains the situation depicted in FIGS. 3A, 3B and 3C.1–3C.4. If one examines the four reduced size schematic drawings in FIGS. 3C.1–3C.4, it becomes clear that the vertical components of the centrifugal forces cancel each other in any given case, while the horizontal components on the other hand are cumulative. One consequently generates alternating horizontal forces directed backwards and forwards corresponding to the sinusoidal curve in FIG. 3B.

For the sake of completeness, it should be mentioned that the exciter shafts with the phase relationship depicted in FIGS. 3A, 3B and 3C.1–3C.4 additionally generate torque about the roller axis as well, that alternately acts in a forwards and backwards direction. This torque is absorbed by an elastic bearing.

While the two figures mentioned above in any given case show the extreme positions of the phase relationship in which either pure vertical compressive forces or pure horizontal shearing forces act on the roller, illustrations 4 and 5 deal with intermediate positions in which compressive forces as well as shearing forces are generated simultaneously. This has proved in practical use to be particularly expedient. Proceeding from FIG. 2A, the right hand exciter shaft has only been rotated ahead about 45° (FIGS. 4A, 4B and 4C.1–4C.4) or rotated backward about 45° (FIGS. 5A, 5B and 5C.1–5C.4). One then obtains a relatively large vertical force component V with a small horizontal force component H corresponding to the respective sinusoidal curve depicted to the right in each Figure. The difference between the FIGS. 4A, 4B, 4C.1 and 4C.4 and FIGS. 5A, 5B and 5C.1–5C.4 resides in the fact that the resulting horizontal force component is adapted to the desired direction of travel.

Figure 6:
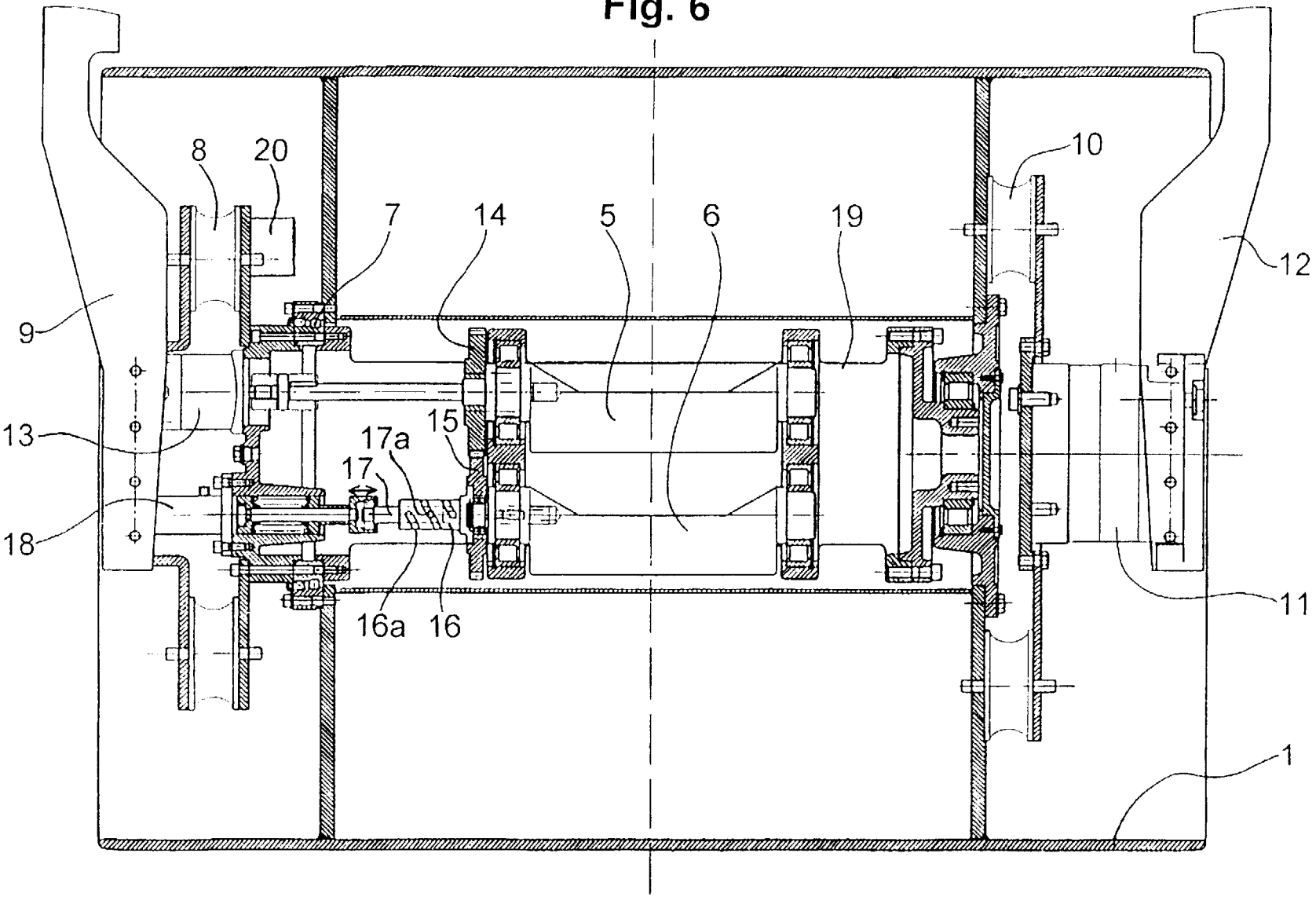
FIG. 6 is an axial section through a roller.

In order to clarify the adjustment of the phase relationship of both exciter shafts relative to each other, reference is now made to FIG. 6. It shows a vertical section through roller 1 whereby, however, the two exciter shafts along with their mountings have been turned 90° into the drawing plane.

Roller 1 is suspended in a manner known per se on the one side by ball bearing 7 and rubber elements 8 on a support 9, on the other side by rubber elements 10 and the drive motor 11 on a support 12. Supports 9 and 12 run in any given case upwards to the frame, that is to body 2*a*.

The two exciter shafts 5 and 6 are arranged in the interior of the roller and are rotatable with respect to it. They are driven by a vibration motor 13 which sets exciter shaft 5 directly into rotation and sets the other exciter shaft rotating through a pair of gears 14, 15. It is now essential that exciter shaft 6 can be rotated relative to gear 15, and to be sure by means of an adjustment coil 16 connected with the gear. This adjustment coil has one or more screw threads 16*a* and is traversed internally by an adjusting axle 17. This adjusting axle 17 carries for its part one or more radially projecting bolts 17*a* which traverse the screw thread 16*a* and permit a form-locking connection between gear 15 and adjusting axle 17. The adjusting axle 17 is subject to axial displacement on its part by an adjusting mechanism 18, but can be freely rotated with respect to this rotating mechanism. On the other hand, it can be axially displaced with respect to exciter shaft 6, but rotates along with it.

In this way, it is possible through axial displacement of the adjusting axle 17 that it screws into or out of the adjustment coil 16 connected with the gear along screw thread 16*a*, whereby exciter shaft 6, which is attached to adjusting axle 17 and rotates with it, is rotated in one or the other direction relative to gear 15. Its phase relationship relative to the phase relationship of exciter shaft 5 is thereby adjusted, and the coordinations represented in FIGS. 2A, 2B, 2C.1–2C.4 to 5A, 5B and 5C.1–5C.4 any intermediate values desired may be set. The entire rotational angle of exciter shaft 6 relative to exciter shaft 5 amounts to almost 360°.

For reasons of stability, exciter shafts 5 and 6 along with the adjusting mechanism 18 are mounted in a housing 19 which for its own part is rotatably mounted in drum 1 and connected with support 9 via rubber elements 8. A motion sensor, for example an acceleration pickup 20, may also be mounted on the housing or an extension thereof adjacent to the rubber elements 8, as shown in FIGS. 1 and 6. The motion sensor may be of any suitable type, known per se, which is capable of detecting relative motion between the roller and the support.

Figure 7:
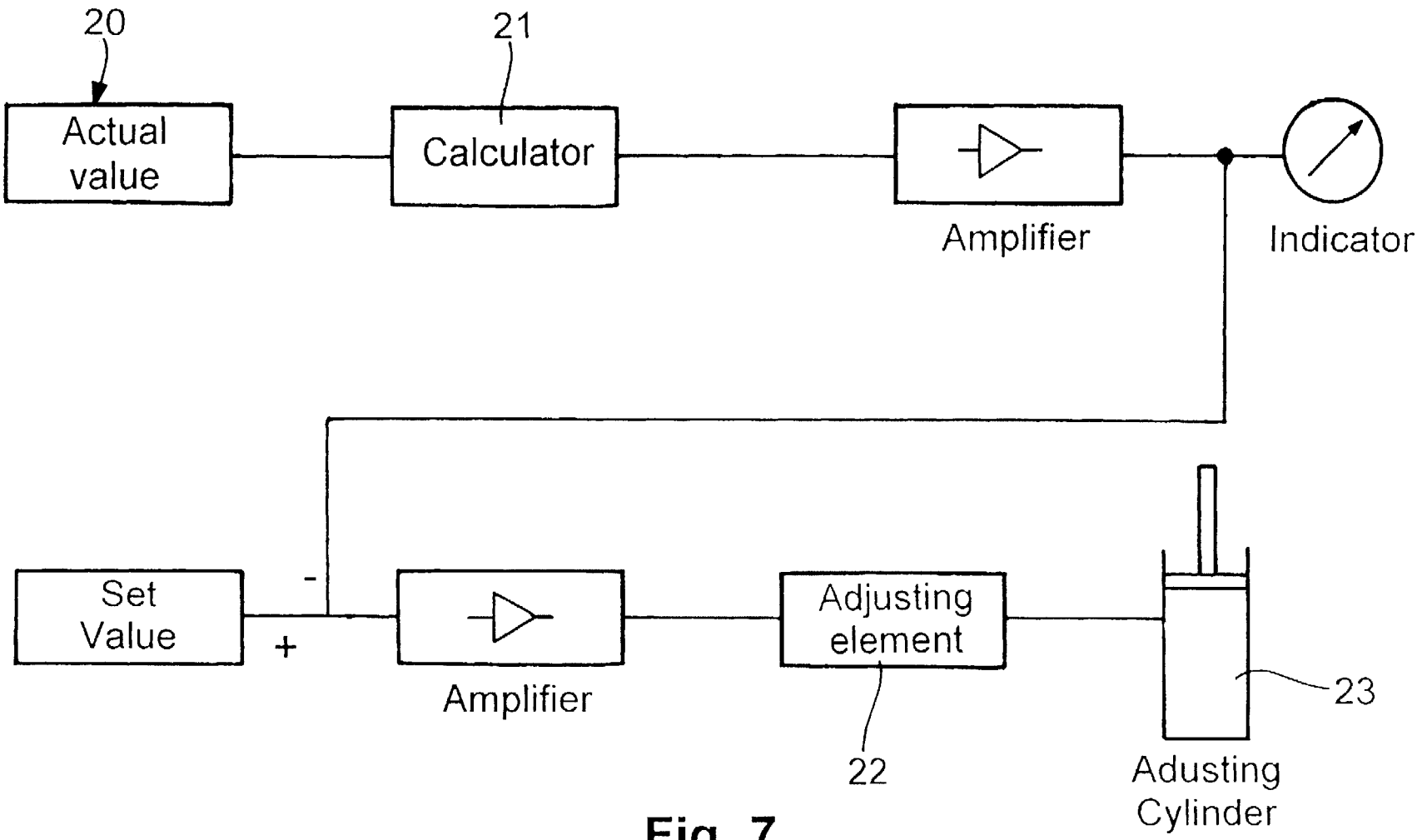
FIG. 7 shows the control loop for restricting bouncing.

The control loop for restricting bouncing is depicted in FIG. 7. It comprises an acceleration pickup 20 which, for example, records the actual value of vertical acceleration of roller 1, whereby it is appropriately allocated to a non-rotating part of the roller or the roller suspension. The measured actual values are fed into a calculator 21 which determines the periodicity, in the present case this is the duration of the vertical vibration component of the roller, and superimposes it upon a predetermined set value of reverse polarity. If the predetermined set value is exceeded, an adjusting element 22 receives a signal and activates for its part the adjustment mechanism 18 via an adjusting cylinder 23 in such a manner that the phase difference between exciter shafts 5 and 6 is so adjusted that the vertical compressive force diminishes in favor of the horizontal shearing force. Adjusting element 22 and adjusting cylinder 23 may form part of or be connected to adjusting mechanism 18, shown in FIG. 6.

FIGS. 8A–8D shows the change in vibratory behavior when the roller begins to bounce owing to increasing soil rigidity. The vertical acceleration component is presented over time or rotational angle of the exciter shafts in FIG. 8A, while in FIG. 8B the vertical and horizontal acceleration components are presented in polar coordinates. The depicted curve progression (a nearly perfect sinusoidal curve or a circle in polar coordinates) appears under normal packing conditions. With increasing soil rigidity, both curve paths depart from their ideal form, and the configurations illustrated in FIGS. 8C and 8D finally appear. The acceleration in a vertical direction, in particular, clearly increases, and one recognizes on the basis of polar coordinates that two ellipses emerge from the circle, the duration of the period thus doubling. The bouncing of the roller is the cause of this, because in any given case a rotation with soil contact follows a rotation of the roller in the air.

Figures 8A, 8B, 8C, 8D:
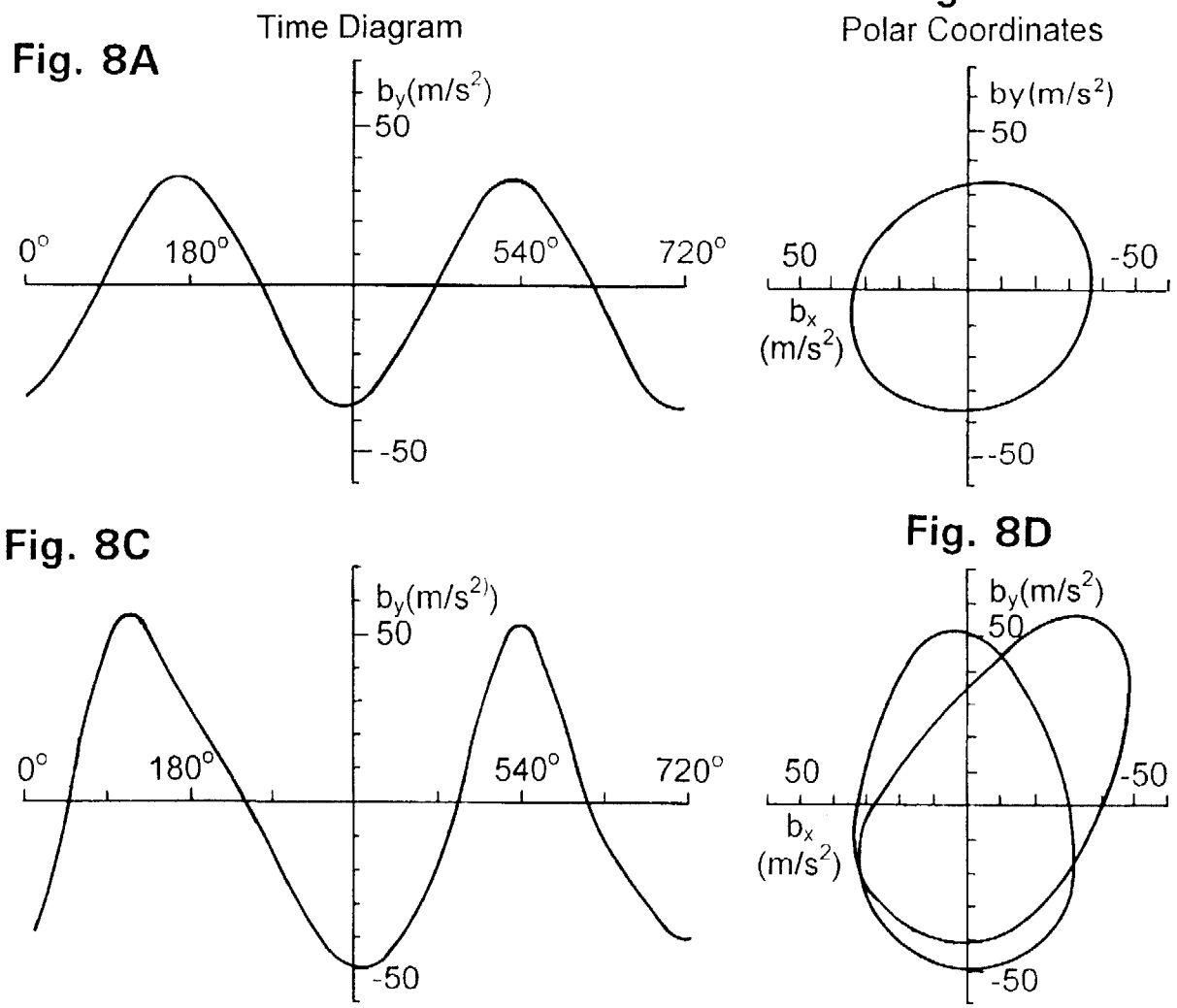
FIGS. 8*a* and 8*b* are a graph showing the vibratory behavior of the packing device under normal packing conditions.
FIGS. 8*c* and 8*d* are a graph similar to FIG. 8*a* showing the vibratory behavior of the packing device in connection with bouncing.

In the example shown, one will enter approximately 40 $m/s^2$ as the upper threshold for the vertical acceleration component in the control loop so that it can in no case come to the behavior depicted in FIG. 8*b*. In this way, bouncing by the packing roller is automatically eliminated, and the packing result no longer depends on the attentiveness and reliability of the operator.

If the soil characteristics do not sharply change, it also lies within the framework of the invention to dispense with the regulation procedure described and instead only to predetermine some fixed intermediate positions for the phase difference between the two exciter shafts. In this case, the determination of disturbances of the basic roller vibration (bouncing operation) would take place by the operator, or with the use of known packing measuring devices, and in the event of disturbances, the phase difference would be adjusted manually or automatically to the next intermediate value at which reduced vertical compressive forces are generated.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A process for dynamic soil packing with at least one advancing roller which executes vibratory motions, in which directionally adjustable vibratory force acts upon the roller so that at least one of horizontal shearing forces and vertical compressive forces are electively exerted on the soil, comprising determining a basic vibratory motion of at least one of the at least one advancing roller and a part connected with the at least one advancing roller, determining whether a deviation exists to at least one of an amplitude, an acceleration, and a period of oscillation of the basic vibratory motion, and upon determining that a deviation exists in the at least one of the amplitude, the acceleration, and the period of oscillation of the basic vibratory motion, decreasing a vertical component of the vibratory force and increasing a horizontal component of the vibratory force until the deviation is corrected.

2. An apparatus for dynamic soil packing comprising at least one advanceable roller (1, 3) having at least two exciter shafts (5, 6) synchronously rotating in opposite directions and arranged one of parallel to and in alignment with a roller axis for generating a vibratory motion, means for adjusting a phase relationship of the shafts such that a resulting centrifugal force electively exerts at least one of horizontal shearing forces and vertical compressive forces on the soil, one of the at least one advanceable roller (1, 3) and a part attached to the at least one roller having a working connection with a motion sensor for determining at least one of an amplitude, an acceleration, and a period of oscillation of the vibratory motion, and the motion sensor being connected to a control loop in communication with the adjusting means which adjusts the phase relationship of the exciter shafts (5,6) to decrease the vertical compressive forces in case of a deviation in the at least one of the amplitude, the acceleration, and the period of oscillation of the vibratory motion.

3. The device according to claim 2, wherein the exciter shafts (5,6) are disposed approximately horizontally alongside each other.

4. The device according to claim 3, whereby the exciter shafts stand in working connection through gears, and at least one of the exciter shafts (6) is connected with its gear (15) via an adjustable pivot bearing (16, 17) for adjustment of its phase relationship.

5. The device according to claim 4, wherein the pivot bearing comprises an adjustment coil (16) connected with the gear (15) and an adjustment axle (17) installed in the coil by axial screwing, the adjustment axle being connected with the exciter shaft (6) in a manner which is axially displacable, but rotationally fixed, to the shaft.

6. The device according to claim 2 wherein the phase relationship is adjustable over a range of greater than 150° up to about 360°.

7. The device according to claim 2, wherein the exciter shafts are mounted in a frame which can be swivelled on an axis parallel to the exciter shafts.

8. The device according to claim 7, wherein the frame, proceeding from a reference position with the exciter shafts being arranged vertically above one another is itself bilaterally adjustable up to approximately 90°.

9. The device according to claim 2 wherein the adjustment of the position and/or phase relationship of the exciter shafts (5, 6) takes place as a function of a direction of travel of the roller.

10. The device according to claim 2 wherein the motion sensor is positioned on a mounting or a part of the roller (1, 3) which cannot rotate.

* * * * *